United States Patent [19]

Appenzeller

[11] 4,440,335

[45] Apr. 3, 1984

[54] SUPPORT ROD STEAMER ROD LOCK

[75] Inventor: Valentin Appenzeller, Kempen, Fed. Rep. of Germany

[73] Assignee: Eduard Küsters, Krefeld, Fed. Rep. of Germany

[21] Appl. No.: 247,324

[22] Filed: Mar. 25, 1981

[30] Foreign Application Priority Data

Apr. 2, 1980 [DE] Fed. Rep. of Germany ..... 3012756

[51] Int. Cl.[3] ..... B65H 17/18; B65H 17/54

[52] U.S. Cl. ..... 226/107

[58] Field of Search ..... 226/107, 104, 105, 106; 68/5 D, 5 E; 34/157

[56] References Cited

U.S. PATENT DOCUMENTS

| | | | |
|---|---|---|---|
| 3,770,174 | 11/1973 | Koster et al. | 226/107 |
| 3,826,417 | 7/1974 | Koster et al. | 226/107 |
| 3,974,950 | 8/1976 | Vertegaal | 226/107 |

*Primary Examiner*—Stanley N. Gilreath

*Attorney, Agent, or Firm*—Kenyon & Kenyon

[57] ABSTRACT

A support rod steamer rod lock has a slot for receiving a support rod end and provided at the slot's ends with normally closed spring-biased latches which at one end of the slot are opened by engagement with the rod end and at the other end of the slot are opened by engagement with a cam.

12 Claims, 6 Drawing Figures

SUPPORT ROD STEAMER ROD LOCK

BACKGROUND OF THE INVENTION

Support rod steamers are used to steam traveling webs of textiles and the like.

Such a steamer is a large sheet metal box filled with steam and having entrance and exit openings between which a horizontal table formed by laterally interspaced rails is positioned. A number of rods are carried on and moved over this table for supporting the web in the form of loops depending from the rods. As the web enters the steamer, one of the rods is lifted so as to form the web into a loop, the rod then being lowered onto the table for movement along its length. At the exit end of the table the rod must be lifted from the table and carried back through the steamer for reuse. This action occurs as to each of the rods.

Endless traveling chains are positioned in the steamer, and these carry pairs of rod locks for the rod's ends. The chains are guided so that at the entrance end of the steamer the rods are successively lifted by their ends so as to successively form the loops in the web, each rod then being carried by the chains and rod locks to a position above the table and then downwardly deposited on the table, at which time each pair of rod locks for each rod must release the rod's ends so that the rod is free to move over the table. At the exit end of the table the chains are guided to carry each pair of rod locks upwardly so as to engage successively the ends of the rods, lift the rods from the table and carry the rods back to the entrance end of the steamer.

The rod locks each have a straight slot aligned with the lock's traveling direction, the slot having an inlet end through which the end of a rod can enter as the lock travels upwardly at the exit end of the table, and the slot having an outlet end through which the rod end can leave the slot while the rod lock travels downwardly at the table's inlet end.

Prior art means provided for locking in the rod ends after entering the slots of the rod locks for transport of the rods and for releasing the rod ends thereafter from the slots, have not been fully satisfactory. That means has used rotative elements rotated by cams in the traveling path of the lock to both lock and unlock the parts with spring biased balls and recesses serving to hold the elements against inadvertent rotation during transport of the rods.

SUMMARY OF THE INVENTION

According to the present invention, such a rod lock has at least one latch at each end of its slot, and they can individually swing towards each other to retracted positions free from the slot and away from each other to fixed positions where the latches project into the slot. The latches have spring means for biasing them to these fixed positions, the latch at the inlet end of the slot having a cam surface adapted for engagement by the rod end when the rod lock travels in a direction towards the rod, such as upwardly, so as to swing the latch free from the slot under the rod's weight and permit the rod end to enter the slot, whereupon the latch via its spring bias snaps back to its fixed position. At this time the rod end is locked firmly in the slot against the other latch. Neither latch can swing away from the other beyond its fixed position where the latch projects into the slot. When the rod lock travels in the opposite direction, such as downwardly, means are provided for swinging the other latch free from the slot at its outlet end so that the rod end is released, preferably by providing this latch with an actuating roller which engages a stationary cam passed which the rod lock is carried. Such a cam can be one of these used to actuate the prior art lock.

In operation, each pair of rod locks is carried upwardly on either side of the horizontal table at its exit end so as to engage the ends of the rods arriving at that end. The spring bias of the latch at the slot's entrance end is made so that the latch is swung by the weight of the rod alone, the latch then snapping back to its locking position in the lock's slot. At the outlet end the latch cannot release the rod because that latch is spring biased to its locking position where it projects into the slot. Each pair of rod locks can therefore carry a rod firmly fixed against disengagement back to the entrance end of the table where the latch at the exit end of the slot is mechanically forced open by the cam action.

For maximum security, two latches are preferably provided at each end of the slot of the rod lock, each pair acting as described before with respect to the other pair.

DESCRIPTION OF THE DRAWINGS

The accompanying drawings are for use in connection with the following detailed description of the invention, the various figures being as follows.

DETAILED DESCRIPTION OF THE INVENTION

Figure 1:
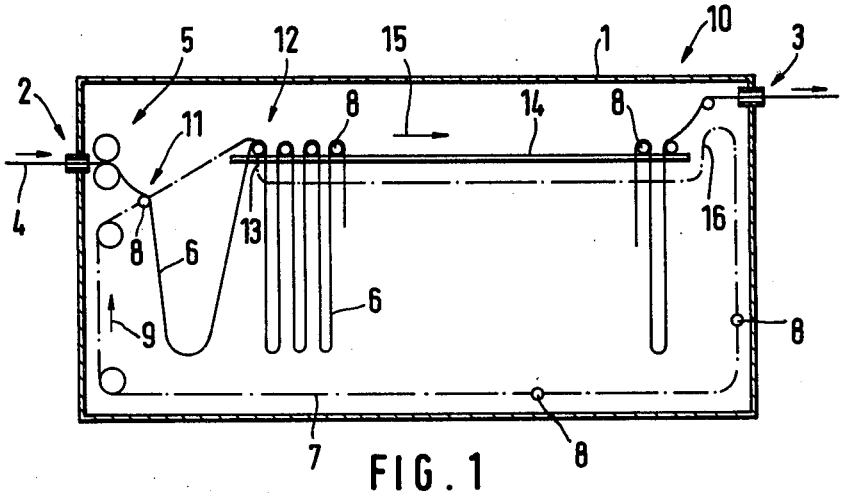
FIG. 1 schematically shows a textile web support rod steamer in vertical section.

The support rod steamer 10 of FIG. 1 comprises a sheet steel steam housing 1 with an entrance 2 and an exit 3 for the traveling web of material 4. The inlet 2 is elevated and the web is fed in by a pair of pinch rolls 5 so as to hang downwardly from these rolls in the form of a partially formed loop 6.

Endless continuously traveling chains 7 run on either side of the web and are guided by sprocket wheels and rollers not shown in detail. These chains carry the pairs of rod locks (not shown in FIG. 1) which transport the many rods 8 used to support the web 4 in the form of a series of traveling depending completed loops **6*a* through the steamer. The chains 7 via the rod locks carry the rods 8 in the direction of the arrow 9 so that each rod in succession engages the front depending side of the first of the loops, shown at 6, and carries it up to the top of the front end of the series of loops. At the location of the arrow 12, the chains through their guiding means go vertically downwardly to form a short section 13 and it is by actuation at this location that the rod locks must release the support rods 8 one after another so that their ends can be carried by the table 14 which is formed by interspaced rails (not shown) and has means for moving the rods 8 towards the exit end of the steamer, the traveling direction being shown by the arrow 15**.

As the rods 8 carrying the depending loop 6 travel along the table 14, the chains 7 outwardly from the sides of the table run beneath the table until at the latter's exit end the chain's are guided vertically upwardly over the short section 16. It is at this location that the rod locks must again engage the ends of the rods successively for transport of the rods back to the entrance end of the steamer, the web then freed from the rods being pulled through the exit 3.

It can be seen from the foregoing that for each of the web loop support rods 8 the chains 7 must have a pair of rod locks adapted to reliably receive the rod ends during vertical travel at the chain sections 16, locking the rod ends positively in place and keeping them locked while being carried to the front end of the steamer, and while the rod now carrying a new web loop is lowered on the front end of the table 14, positively and reliably releasing the rod ends. All of the parts must, of course, be made of corrosion resistant metal because the casing 1 is filled with hot steam. Preferably the rod locks are made of parts which can be cut and possibly machined from commercially available stainless steel plate stock without requiring the use of castings or forgings in view of their expense. Reliability is important, particularly considering the fact that in view of the thermal conditions involved one rod lock of any one pair may possibly become misaligned with the other one. The new rod lock described by the following meets all of these requirements.

Figure 2:
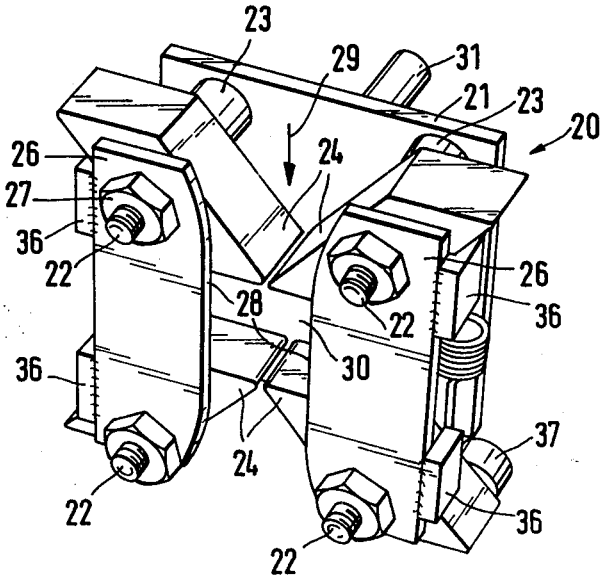
FIG. 2 is a perspective view of the new rod lock showing its side which faces the rods.
Figure 3:
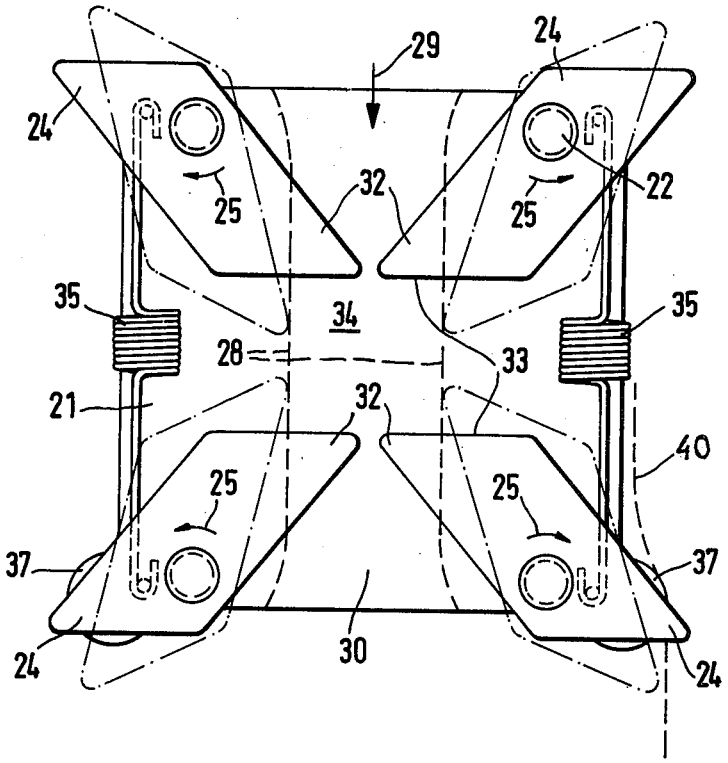
FIG. 3 is a front view of FIG. 2 with certain parts removed to expose details.
Figure 4:
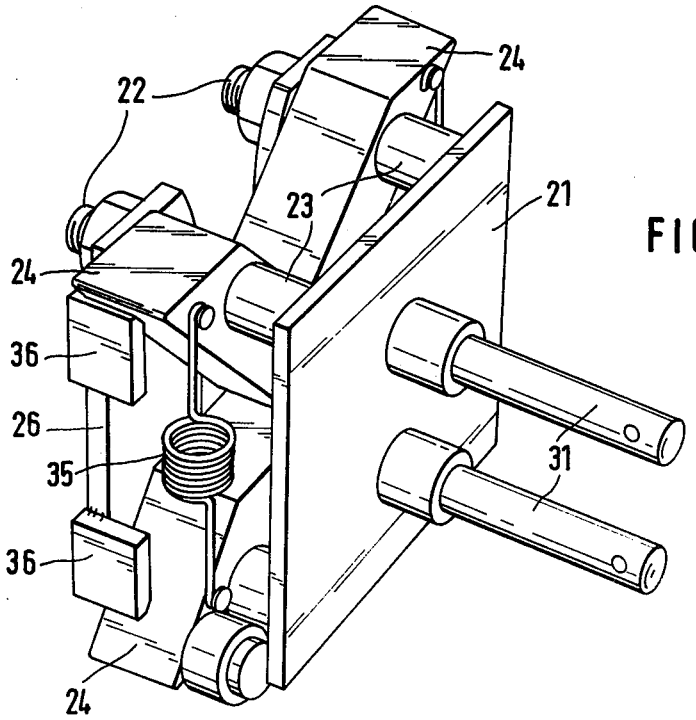
FIG. 4 is like FIG. 2 but shows the opposite ends of the rod lock.

Referring now to FIGS. 2 through 4, the new rod lock is constructed on a flat rectangular base plate 21 having a front facing away from its transporting chain, and from which four screw bolts 22 extending forwardly from locations adjacent to the corners of the plate. Spacer sleeves 23 on these bolts space away from the plate four trapezoidal shaped latches which are pivoted on the bolts so as to swing from the positions shown by solid lines in FIG. 3 in the direction of the arrows 25 to the positions shown by broken lines. The four latches are retained on their respective bolts by two mutually parallel narrow plates 26 held on the bolts by nuts 27. The interfacing edges 28 of these narrow plates are mutually parallel and are interspaced a distance corresponding to the diameter of the rod ends which the rod locks are designed to handle. In this way a slot 30 is formed for receiving the end of the rod in the direction of the arrow 29. This slot 30 should be aligned with the traveling direction of the rod lock, and for this purpose two chain pins 31 extend from the back or inner face of the base plate 21. With the usual sprocket chain construction these pins may be used as two of the link pins interconnecting two links, so the slot 30 is held in alignment with the chain and its traveling direction. As usual, the free ends of the pins 31 would be held together by the usual chain link strap (not shown). The chain and the strap are not illustrated because their construction is well known.

Normally the latches 24 are positioned with their acute corners 32 projecting into the slot 30, their end edges facing each other being made so they are parallel to each other with an interspacing the same as the diameter of the rod end for which the space 30 is designed. The latch tips 32 almost touch each other as to each pair. It is possible to have only one of the latches for each end of the portion of the slot 30 defined by what is then only two of the latches which then swing away from each other to the positions shown in solid lines by FIG. 3, swinging action towards each other then freeing the slot 30 from the latch corners 32. Preferably the two pairs of latches illustrated are used.

As explained hereinafter, the rods 8, when designed for this new rod lock, are made rectangular in cross section. Consequently, the mutually parallel edges 28 of the narrow plates 26 and the interfacing edges 33 of the latches are designed to cooperatively define a correspondingly rectangular capture space 34 for the rod ends when the latches are swung to the positions shown by solid lines in FIG. 3.

Each two of the latches, which are arranged in tandem one above the other, in FIG. 3 are shown connected to each other by tension springs 35 on ends of the latches which project outwardly so that the latches are all spring biased to their locking positions. Torque on the latches in the direction indicated by the arrows 25 is directed counter to this spring bias. To hold the latches fixed in their normal positions, stops 36 are welded on the long plates 26 so as to project towards the plate 21 behind the outer edges of the latches and holding them fixed in their normal positions against the spring bias exerted by the springs 35. These springs 35 have a tension designed to exert a spring bias on the latches which can be overcome by the weight of the rods 8 as to each pair of the rod locks and each rod 8. Therefore, when a rod end enters the slot 30 in the direction of the arrow 29, due to the travel of the rod lock in the opposite direction, the appropriate pair of latches are easily cammed open by the rod end, the latches snapping back to their normal positions when the rod end is safely in the space 34. This action occurs when the rod locks move upwardly in the region 16 shown by FIG. 1, the rod locks picking up the rod ends with the upper latches swinging against the bias of the springs 35 and then snapping shut with the rod ends safely locked for transport towards the front end of the steamer of FIG. 1. Displacement force exerted by the rod ends on the latches is in a direction tending to rock the latches of each pair towards each other as to their corners 32 and surfaces 33, a rocking direction against which the latches are positively locked by the stops 36. Great locking security is obtained. This locking action is completely independent of the position of one rod lock relative to the other of any pair of the locks and it cannot be influenced by shock or vibration. The outer edge of each latch slants inwardly towards the space 34 to provide what are in effect cam surfaces engaged by the rod end and assuring its easy entry to the space 34.

The rod end must enter one end of the slot 30 and leave via its opposite end. Therefore, the latches, at what might be called the outlet end of the slot 30, on their ends projecting outwardly beyond the bolts 22, are provided with rollers 37. This is the trailing end of the rod lock so by using the usual cam surfaces shown in dotted lines 40 in FIG. 3, in the traveling path of the lock, these rollers 37 may be engaged so as to swing the latches away from the slot 30 to release the rod end. These fixed cam surfaces 40 in the case of FIG. 1 are located for operation in the area indicated at 13. At this location each rod lock will be inverted from its position shown by FIGS. 2 through 4 so actuation of the rollers 37 by the fixed cams 40 swing the latches at the outlet end of the slot. Now the upper end of the slot is open so that as the rod lock continues downwardly the rod involved is left resting on the interspaced rails of the table 14 with the web loop running over this rod. The web is continuously traveling into and from the steamer chamber 1, but it is static or nontraveling while carried in loop form by the rods 8 over the table 14.

Figure 5:
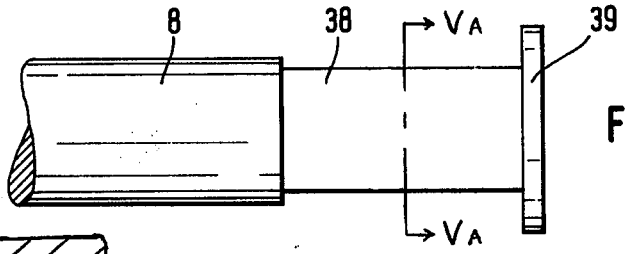
FIG. 5 is an elevation view of one of the rods with a new rod end for cooperation with the new rod lock.
Figure 5A:
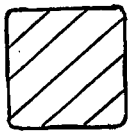
FIG. 5A is a cross section through FIG. 5

As indicated by FIG. 5 and FIG. 5A, the rod ends 38 of the support rods 8 are preferably formed with a rectangular or square cross section fitting the rectangular space 34 formed by the new rod lock. This prevents the rods from rotating while riding over the table 14 because in each instance a flat rod end side is resting on the flat table surface, formed by the interspaced rails. This prevents tensioning of the web and in addition holds each rod end against rotation in the rod lock such as might otherwise cause canting or jamming. Also, this rod end 38 has a flange 39 on its outermost end which fits between latches 24 and base plate 21 so as to positively prevent the rod end from being pulled axially from the rod lock.

What is claimed is:

1. In a rod lock for a support rod steamer for steaming webs of textile and similar materials, said steamer including a guide at the beginning thereof and extending over the length of said steamer; a support rod conveyor endlessly revolving in the loop plane of the material to which rod locks are attached, said conveyor conveying support rods in a loop from the end of said guide to the beginning of said guide, each rod lock comprising a base body firmly connected to said support rod conveyor having a slot open on both sides in the travel direction of the conveyor, for receiving the end of a support rod and a locking element arrangement rotatable relative to the base body in a plane of the loops for closing off openings of the slot when a support rod has been received at the end of said guide, and an external control cam for releasing said locking element arrangement in order to release the support rod at the beginning of said guide, the improvement comprising said locking body arrangement comprising:

(a) at least first and second locking elements arranged in tandem spaced from each other in the direction of the slot supported in axes perpendicular to the plane of the loops;

(b) means resiliently biasing said rotatable locking elements into a position of rotation in which they lock the receiving region of the slot from the outside but so that the leading locking elements can be rotated out of the slot merely by the weight of the support rod; and (c) stops against which said rotatable locking elements are resiliently held.

2. The improvement according to claim 1 wherein said locking body arrangement comprises a rectangular member having two sides parallel with the two sides of said slot and four locking segments supported for rotation about axes located at the corners of said rectangle, two of said locking segments disposed on each side of said slot.

3. The improvement according to claim 2 wherein said locking elements have an approximately diamond shape as viewed in elevation in the plane of the loop and wherein when rotated into the locking position, said acute corners extend into said slot.

4. The improvement according to claim 3 wherein said means resiliently biasing said locking elements comprises a spring arrangement.

5. The improvement according to claim 4 wherein said spring arrangement comprises tension springs engaging said locking elements on the side of said axes opposite of said slot and arranged to exert a tension force parallel to said slot.

6. The improvement according to claim 5 and further including dogs for cooperation with the external control cam disposed on the outer ends of the locking elements which lag in the travel direction.

7. Apparatus according to claim 6 wherein said dogs comprise rotatably supported rollers.

8. Apparatus according to claim 1 or 7 wherein said base body comprises a plate with at least two opposite edges which are parallel to each other and said means forming a slot comprises first and second further plates each having an edge parallel to and opposed to an edge of the other and also parallel to said parallel edges of said base plate; and pins connecting said further plates to said base body with a spacing, said locking elements supported for rotation on said pins, said pins thereby defining the axes of said locking elements.

9. The improvement according to claim 8 wherein said stops comprise projections at said first and second further plates projecting into the path of rotation of said locking elements disposed between said pins.

10. Apparatus according to claim 8 and further including stops for said locking elements for limiting rotation in the opening direction.

11. The improvement according to claim 8 wherein each of said support rods includes a radial end flange and further including means spacing said locking elements from said base body a distance corresponding to the thickness of said end flanges.

12. The improvement according to claim 8 wherein said support rods have a polygonal cross-section at least at their ends.

* * * * *